US009916803B2

(12) United States Patent
Hohjoh

(10) Patent No.: US 9,916,803 B2
(45) Date of Patent: Mar. 13, 2018

(54) DISPLAY DEVICE, METHOD FOR CONTROLLING DISPLAY DEVICE, AND METHOD FOR DRIVING DISPLAY DEVICE

(71) Applicant: Sharp Kabushiki Kaisha, Osaka-shi, Osaka (JP)

(72) Inventor: Naohiro Hohjoh, Osaka (JP)

(73) Assignee: SHARP KABUSHIKI KAISHA, Sakai City, Osaka (JP)

( * ) Notice: Subject to any disclaimer, the term of this patent is extended or adjusted under 35 U.S.C. 154(b) by 0 days.

(21) Appl. No.: 15/163,853

(22) Filed: May 25, 2016

(65) Prior Publication Data

US 2016/0358574 A1 Dec. 8, 2016

(30) Foreign Application Priority Data

Jun. 8, 2015 (JP) ..... 2015-116108

(51) Int. Cl.
*G09G 3/36* (2006.01)

(52) U.S. Cl.
CPC ..... *G09G 3/3666* (2013.01); *G09G 3/3614* (2013.01); *G09G 2310/0221* (2013.01); *G09G 2320/0233* (2013.01); *G09G 2320/0242* (2013.01); *G09G 2320/0285* (2013.01)

(58) Field of Classification Search
CPC .. G09G 3/2074; G09G 3/3666; G09G 3/3677; G09G 3/3688; G09G 2320/0646; G09G 2310/0221
USPC ..... 345/690–697
See application file for complete search history.

(56) References Cited

U.S. PATENT DOCUMENTS

2014/0085279 A1 3/2014 Shiomi
2015/0109357 A1 4/2015 Nakai et al.

FOREIGN PATENT DOCUMENTS

JP H09211475 A 8/1997
JP 2000003158 A 1/2000
JP 2004086093 A 3/2004
JP 2009-186616 A 8/2009
JP 2014-048421 A 3/2014
WO WO-2012157651 A1 11/2012

*Primary Examiner* — Michael Pervan
(74) *Attorney, Agent, or Firm* — ScienBiziP, P.C.

(57) ABSTRACT

A display device includes a display panel including a first display region and a second display region and boundary correction circuits that perform tone correction on display data in such a manner that a correction amount for the display data to be written to a first pixel adjacent to a boundary between the first display region and the second display region and a correction amount for the display data to be written to a second pixel not adjacent to the boundary are different from each other.

12 Claims, 6 Drawing Sheets

DISPLAY DEVICE, METHOD FOR CONTROLLING DISPLAY DEVICE, AND METHOD FOR DRIVING DISPLAY DEVICE

BACKGROUND

1. Field

The present disclosure relates to a display device including divided display regions.

2. Description of the Related Art

Some high-definition display devices including, for example, 4K2K picture elements (3840 picture elements in width and 2160 picture elements in length) or 8K4K picture elements (7680 picture elements in width and 4320 picture elements in length) may not have enough time to write a display data signal to each pixel electrode. Accordingly, in order to have enough time to write a signal, a divisional drive technology exists in which a screen is divided into upper and lower display regions that are driven concurrently and in parallel.

Japanese Unexamined Patent Application Publication No. 2014-048421 discloses a technique for delaying the output of video signals corresponding to a plurality of pixels positioned at a centermost portion in the case where, in a display device that is driven by a divisional drive technology, scanning is performed from an end of each of the divided display regions toward the center.

The wiring capacitance and wiring resistance generated by data signal lines influence data signals that are output from a data driver to the data signal lines in such a manner that waveforms of the data signals become less sharp and more rounded as the data signal lines are closer to the boundary between divided display regions having long wiring distances. In addition, since the upper and lower display regions of the screen are driven in parallel, waveforms of data signals change discontinuously at the boundary portion compared with the other portions. For example, this may cause the boundary portion to display a line having a brightness different from that in the other portions even if a single tone image is to be displayed on the entire screen.

With the technique disclosed in Japanese Unexamined Patent Application Publication No. 2014-048421, it is difficult to sufficiently compensate for the influence of a rounded waveform of a data signal. In addition, in the technique disclosed in Japanese Unexamined Patent Application Publication No. 2014-048421, a data driver that can delay the output of video signals has to be used.

SUMMARY

It is desirable to implement a display device that improves the display quality at the boundary portion between the divided display regions.

According to an aspect of the disclosure, there is provided a display device including a display panel including a first display region and a second display region that are adjacent to each other and configured to be driven by using mutually different scan signal line groups and mutually different data signal line groups, and a tone correction unit configured to perform tone correction on display data having a certain tone in such a manner that a correction amount for the display data to be written to a first pixel adjacent to a boundary between the first display region and the second display region and a correction amount for the display data to be written to a second pixel not adjacent to the boundary are different from each other.

According to an aspect of the disclosure, there is provided a display device including a display panel including a first display region and a second display region that are adjacent to each other and configured to be driven by using mutually different scan signal line groups and mutually different data signal line groups. An output voltage of a data signal line corresponding to a first pixel that is adjacent to a boundary between the first display region and the second display region and that displays display data having a certain tone with a polarity is different from an output voltage of a data signal line corresponding to a second pixel that is not adjacent to the boundary and that displays display data having the same tone with the same polarity.

According to an aspect of the disclosure, there is provided a method for controlling a display device including a display panel including a first display region and a second display region that are adjacent to each other and configured to be driven by using mutually different scan signal line groups and mutually different data signal line groups, the method including performing tone correction on display data having a certain tone in such a manner that a correction amount for the display data to be written to a first pixel adjacent to a boundary between the first display region and the second display region and a correction amount for the display data to be written to a second pixel not adjacent to the boundary are different from each other.

According to an aspect of the disclosure, there is provided a method for driving a display device including a display panel including a first display region and a second display region that are adjacent to each other and configured to be driven by using mutually different scan signal line groups and mutually different data signal line groups, the method including causing an output voltage of a data signal line corresponding to a first pixel to differ from an output voltage of a data signal line corresponding to a second pixel, the first pixel being adjacent to a boundary between the first display region and the second display region and displaying display data having a certain tone with a polarity, the second pixel being not adjacent to the boundary and displaying display data having the same tone with the same polarity.

DESCRIPTION OF THE EMBODIMENTS

First Embodiment

Figure 1:
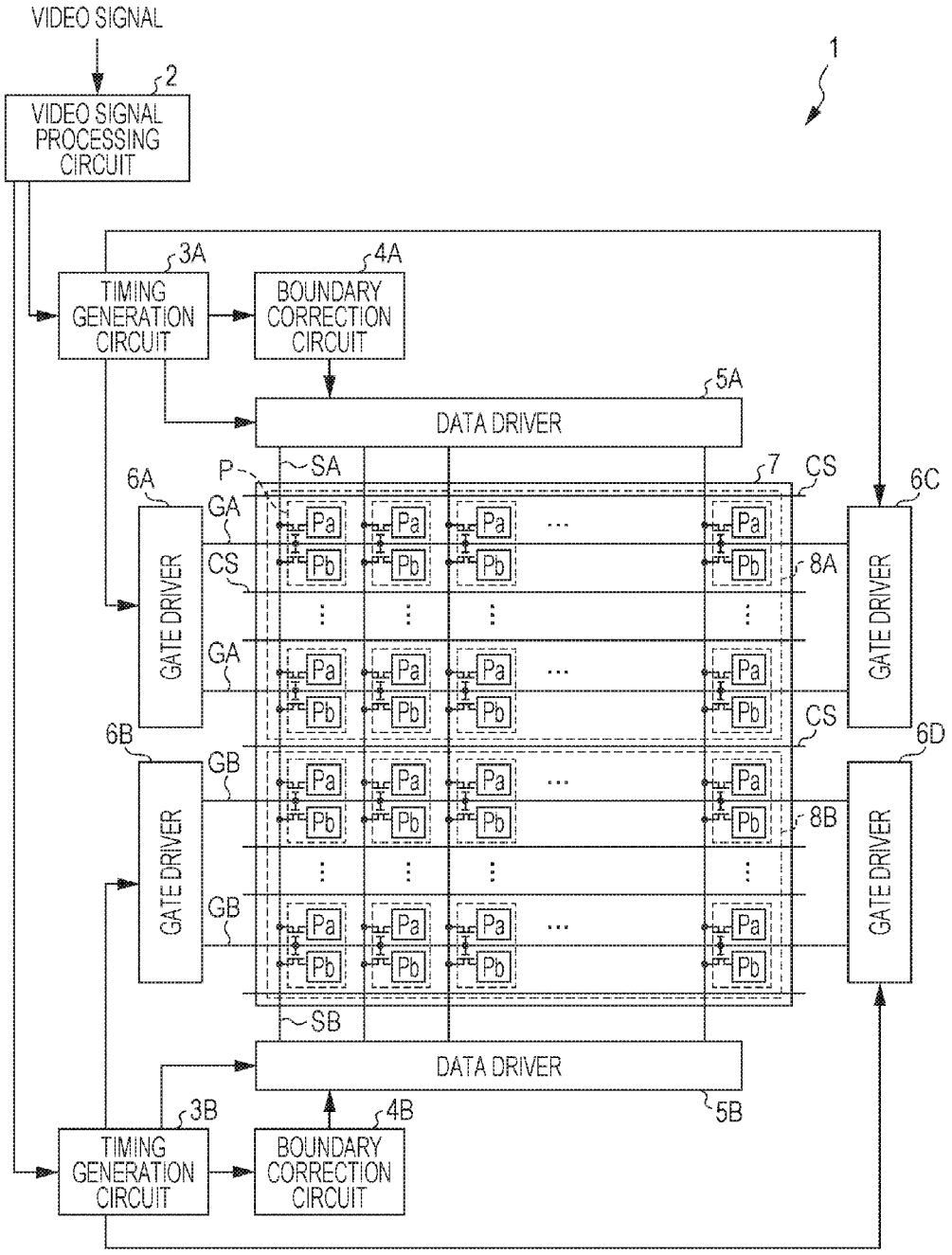
FIG. 1 is a block diagram illustrating a schematic configuration of a display device according to an embodiment of the present disclosure.

FIG. 1 is a block diagram illustrating a schematic configuration of a display device 1 according to a first embodiment of the present disclosure. The display device 1 includes a video signal processing circuit 2, timing generation circuits 3A and 3B, boundary correction circuits 4A and 4B (tone correction units), data drivers 5A and 5B, gate drivers 6A to 6D (scan signal line drivers), and a display panel 7.

The display panel 7 includes two display regions adjacent to each other: a display region 8A and a display region 8B. As illustrated, the display panel 7 is divided into upper and lower display regions. The display panel 7 includes a plurality of scan signal lines GA and a plurality of data signal lines SA arrayed in the display region 8A, and a plurality of scan signal lines GB and a plurality of data signal lines SB arrayed in the display region 8B. The plurality of scan signal lines GA constitute a scan signal line group, the plurality of data signal lines SA constitute a data signal line group, and the scan signal line group and the data signal line group drive the display region 8A. The plurality of scan signal lines GB constitute a scan signal line group, the plurality of data signal lines SB constitute a data signal line group, and the scan signal line group and the data signal line group drive the display region 8B. Each scan signal line extends in the row direction (horizontal direction), and each data signal line extends in the column direction (vertical direction). The display regions 8A and 8B are integrally formed on the display panel 7; however, the data signal lines are separated into upper lines and lower lines at the boundary between the display regions 8A and 8B. The display panel 7 includes a plurality of pixels P. Here, each pixel P includes two sub-pixels: a sub-pixel Pa and a sub-pixel Pb. Each of the sub-pixels Pa and Pb includes a transistor (switching element) and includes a pixel electrode that forms a pixel capacitor. The transistors in the sub-pixels Pa and Pb in each pixel P are driven by a corresponding one of the scan signal lines, which is connected to the gate terminals of the transistors. The same display data is written to the sub-pixels Pa and Pb in each pixel P from a corresponding one of the data signal lines through the respective transistors.

The display panel 7 also includes a plurality of storage capacitor lines CS that extend in the row direction. Each storage capacitor line CS is provided between two pixels P adjacent to each other in the column direction. In addition, a storage capacitor line CS is provided above the top-row pixels P, and a storage capacitor line CS is provided below the bottom-row pixels P. Each storage capacitor line CS forms a storage capacitor between a pixel electrode of a sub-pixel Pa and a pixel electrode of an adjacent sub-pixel Pb. Storage capacitor line drivers (not illustrated) drive the plurality of storage capacitor lines CS from respective ends thereof in such a manner that the voltage of the storage capacitor lines CS changes periodically in a frame period.

Here, each pixel electrode and a common electrode with liquid crystals interposed therebetween form a pixel capacitor. That is, each pixel P (including the sub-pixels Pa and Pb) is a liquid crystal element, the display panel 7 is a liquid crystal display panel, and the display device 1 is a liquid crystal display device. The following description will illustrate a liquid crystal display panel as an example; however, it is possible to use, as the display panel 7, any display panel to which display data is written by an active-matrix driving method, such as an organic electroluminescence (EL) display panel. A pixel P typically reproduces any one of the color components of red (R), green (G), and blue (B), and three pixels P reproducing R, G, and B correspond to a picture element.

Flow of Video Signals

The video signal processing circuit 2 performs various kinds of video signal processing on input video signals in a unit of a frame (corresponding to a screen). Then, the video signal processing circuit 2 divides display data for a frame (screen) such that the divided display data items correspond to the display regions 8A and 8B, which are upper and lower divided display regions. The video signal processing circuit 2 outputs display data corresponding to the display region 8A to the timing generation circuit 3A and outputs display data corresponding to the display region 8B to the timing generation circuit 3B. In this process, the video signal processing circuit 2 may delay the output of display data corresponding to the display region 8B in such a manner that the display data corresponding to the display region 8B is output later than the display data corresponding to the display region 8A by a frame period. A frame period is a period for updating the display in all the pixels. In a display device that updates the display at a refresh rate of 60 Hz, a frame period is 1/60 seconds. Here, it is assumed that the frame rate of video signals is also 60 Hz.

The timing generation circuit 3A sequentially outputs, to the boundary correction circuit 4A, display data corresponding to the display region 8A from the top row of the display region 8A. In order to write the display data to the display panel 7, the timing generation circuit 3A generates a timing signal that drives the data driver 5A and timing signals that drive the gate drivers 6A and 6C. The timing generation circuit 3A outputs the timing signals to the data driver 5A and the gate drivers 6A and 6C.

In the same manner, the timing generation circuit 3B sequentially outputs, to the boundary correction circuit 4B, display data corresponding to the display region 8B from the top row of the display region 8B. In order to write the display data to the display panel 7, the timing generation circuit 3B generates a timing signal that drives the data driver 5B and timing signals that drive the gate drivers 6B and 6D. The timing generation circuit 3B outputs the timing signals to the data driver 5B and the gate drivers 6B and 6D.

The boundary correction circuits 4A and 4B perform tone correction on the input display data. The boundary correction circuit 4A performs tone correction on the display data corresponding to the display region 8A, and the boundary correction circuit 4B performs tone correction on the display data corresponding to the display region 8B. Each of the boundary correction circuits 4A and 4B stores a preset correction amount table. By referring to the correction amount table, each of the boundary correction circuits 4A and 4B determines the correction amount for the display data in accordance with the tone indicated by the input display data and the coordinates (x, y) of a pixel P to which the display data is to be written. The boundary correction circuit 4A outputs the corrected display data to the data driver 5A, and the boundary correction circuit 4B outputs the corrected display data to the data driver 5B.

It is assumed that Din represents the tone indicated by the input display data, (x, y) represents the coordinates (column, row) of a pixel P to which the display data is to be written, and Dout represents the tone indicated by the corrected display data. The boundary correction circuits 4A and 4B perform tone correction in such a manner that Dout=Din+H(Din, x, y) is satisfied. Here, H represents a correction amount and is determined in accordance with Din, x, and y on the basis of the correction amount table. The tone correction will be described later in detail.

In accordance with a timing signal, the data driver 5A outputs, to the plurality of data signal lines SA in the display region 8A, voltages (data signals) corresponding to a plurality of corrected display data items corresponding to a plurality of columns. In accordance with timing signals, the gate drivers 6A and 6C sequentially output scan signals (gate pulses) to the top-row scan signal line GA through the bottom-row scan signal line GA in the display region 8A. The gate drivers 6A and 6C drive the same scan signal line GA from respective ends thereof. The display data is written to a pixel P by inputting the voltage corresponding to the display data to the pixel electrode.

In the same manner, in accordance with a timing signal, the data driver 5B outputs, to the plurality of data signal lines SB in the display region 8B, voltages corresponding to a plurality of corrected display data items corresponding to a plurality of columns. In accordance with timing signals, the gate driver 6B sequentially outputs scan signals to the top-row scan signal line GB through the bottom-row scan signal lines GA in the display region 8B. The gate drivers 6B and 6D drive the same scan signal line GB from respective ends thereof.

The mutually different data drivers 5A and 5B and gate drivers 6A to 6D drive the display regions 8A and 8B concurrently and in parallel. For example, during the first horizontal period in a vertical period, display data is written to the top-row pixels in the display region 8A and the top-row pixels in the display region 8B. During the last horizontal period in the vertical period, display data is written to the bottom-row pixels in the display region 8A and the bottom-row pixels in the display region 8B. In this manner, video signals at a frame rate of 60 Hz are written as display data to the top-row pixels through the bottom-row pixels in the display region 8A and to the top-row pixels through the bottom-row pixels in the display region 8B in parallel in 1/60 seconds (in a frame period). Note that the video signal processing circuit 2 delays the output of display data to be written to the pixels in the display region 8B by a frame period, and accordingly, subsequently to the writing of the display data of the upper half of the image corresponding to a frame (screen) of video signals to the display region 8A, the display data of the lower half of the image can be written to the display region 8B. Thus, it is possible to avoid screen tearing (misalignment of a displayed object due to a difference in display time) at the boundary portion. Note that the timing generation circuit 3B, the boundary correction circuit 4B, or the like may delay the output of display data for the display region 8B.

As the distance of a pixel P from the data drivers 5A and 5B increases, the waveform of a data signal becomes more rounded owing to the wiring capacitance and wiring resistance. Similarly, as the distance of a pixel P from the gate drivers 6A to 6D or the storage capacitor line drivers increases, the waveform of a scan signal or storage capacitor signal becomes more rounded. Therefore, near the boundary between the display region 8A and the display region 8B, particularly at a center portion in the horizontal direction, the waveform of each signal is more rounded. In addition, pixels adjacent to the boundary (the bottom-row pixels in the display region 8A and the top-row pixels in the display region 8B) are discontinuously driven compared with the pixels in the other portions. Specifically, a horizontal period for driving the bottom-row pixels in the display region 8A is followed by a vertical blanking interval, not the next horizontal period. Therefore, the states of voltages applied to the data signal lines SA and the scan signal lines GA after the horizontal period of the bottom-row pixels in the display region 8A are different from the states of voltages applied during the horizontal period of the pixels in the other portions (pixels at an intermediate portion).

Similarly, a horizontal period for driving the top-row pixels in the display region 8B starts subsequently to the vertical blanking interval, not the previous horizontal period. There is no horizontal period immediately before the horizontal period for driving the top-row pixels in the display region 8B; that is, neither of data signals and scan signals corresponding to display data are supplied to the data signal lines SB and the scan signal line GB immediately before the horizontal period. Accordingly, in the horizontal period (the horizontal period for driving the top-row pixels in the display region 8B) during which data signals and scan signals are supplied initially after the vertical blanking interval, waveforms of the data signals and the scan signals are more rounded. In this manner, the states of voltages applied to the data signal lines SB and the scan signal line GB after the horizontal period for driving the top-row pixels in the display region 8B are different from the states of voltages applied during the horizontal period for driving the pixels in the other portions.

In the case where the display region is not divided, such a specific pixel (discontinuously driven pixel) appears at the upper or lower end of the screen. Accordingly, the influence thereof is unlikely to be visible. On the other hand, for example, in the case where the display panel 17 includes the divided display regions as in the display device 1, such a specific pixel appears adjacently to the boundary between the divided display regions. In this case, even if display data with the same tone is written to the entire screen, without tone correction by the boundary correction circuits 4A and 4B, a line having a brightness different from that in the other portions might be displayed at or near the boundary portion. This line having a different brightness might appear at the center of the screen and can thus be highly visible, resulting in decreased display quality. The difference in brightness becomes greater at or near the center in the horizontal direction owing to rounded waveforms of scan signals or storage capacitor signals. Thus, a dark line having a lower brightness than in the other portions might be displayed at the boundary portion. In particular, a dark line is more likely to be displayed in the top-row pixels in the display region 8B, which are initially driven. A line having a different brightness displayed at the boundary portion may be a dark line or a bright line depending on the configuration and property of the display panel 7.

Tone Correction

Figure 2:
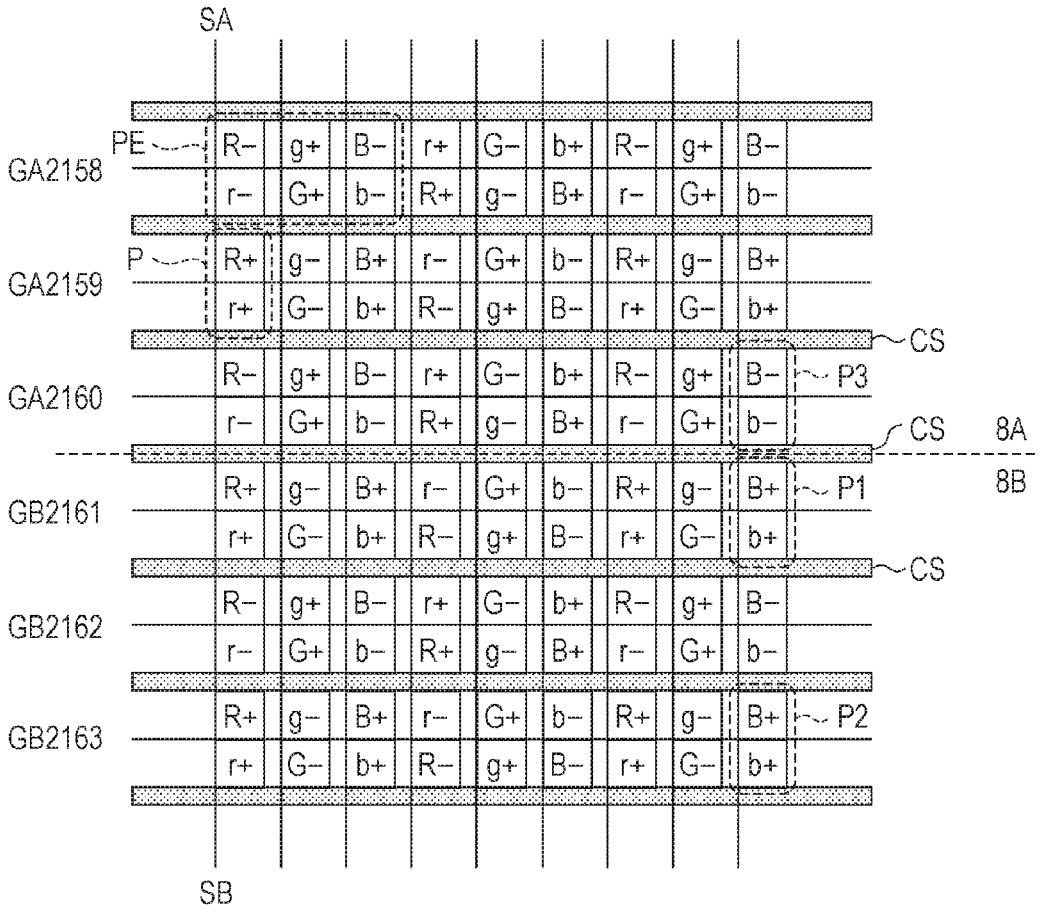
FIG. 2 is an enlarged view of a schematic configuration of a display panel of the display device at and near the boundary between divided display regions.

FIG. 2 is an enlarged view of a schematic configuration of the display panel 7 at and near the boundary between divided display regions. Rectangles with uppercase letters (R, G, and B) represent bright sub-pixels of the respective colors. Rectangles with lowercase letters (r, g, and b) represent dark sub-pixels of the respective colors. The display panel 7 is a multi-pixel panel, and each pixel P includes a bright sub-pixel and a dark sub-pixel. Each picture element PE includes three pixels P for R, G, and B. Here, the display device 1 performs dot inversion driving. Accordingly, pixels P that are next to each other in the vertical or horizontal direction have inverted polarities. The polarities of the pixels P become inverted in each frame. Since a plurality of sub-pixels arrayed in the row direction are driven by the same storage capacitor signal through a corresponding storage capacitor line CS, on the same row, a high brightness and a low brightness are inverted between a sub-pixel having the positive polarity and a sub-pixel having the negative polarity. The embodiment of the present disclosure is not limited to the above example, and the display device 1 may perform line inversion driving or column inversion driving.

The data signal lines SA and SB are separated at the boundary between the display region 8A and the display region 8B. A storage capacitor line CS is provided at the boundary and runs between two pixels P. The scan signal lines GA and GB each run between a bright sub-pixel and a dark sub-pixel of a corresponding pixel.

Figure 3:
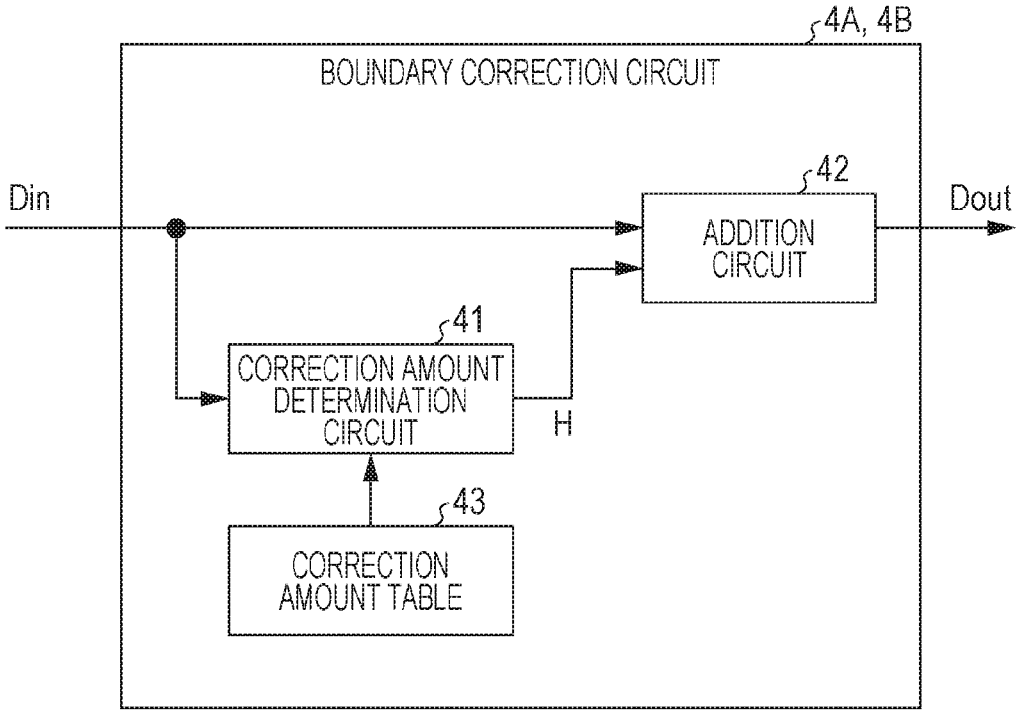
FIG. 3 is a block diagram illustrating a configuration of a boundary correction circuit of the display device.

FIG. 3 is a block diagram illustrating a configuration of each of the boundary correction circuits 4A and 4B. Each of the boundary correction circuits 4A and 4B includes a correction amount determination circuit 41, an addition circuit 42, and a correction amount table 43. The display data indicating the tone Din, which has been input to each of the boundary correction circuits 4A and 4B, is input to the correction amount determination circuit 41 and the addition circuit 42.

The correction amount table 43 is a lookup table in which a corresponding correction amount H is set using, as variables, the input tone Din and the coordinates (x, y) of a pixel (picture element) to which display data is to be written. For example, x represents a picture element column number, and y represents a picture element row number. The display data items corresponding to the respective pixels are input to the boundary correction circuits 4A and 4B in a predetermined order. For example, by counting the sequentially input display data items, the correction amount determination circuit 41 specifies the coordinates of a pixel to which the display data is to be written. By referring to the correction amount table 43, the correction amount determination circuit 41 determines a correction amount H in accordance with the input tone Din of the display data and the coordinates (x, y). The correction amount determination circuit 41 outputs the correction amount H to the addition circuit 42.

The addition circuit 42 adds the tone Din to the correction amount H, thereby generating and outputting display data having the corrected tone Dout. If a delay of a process is caused by the correction amount determination circuit 41, the addition circuit 42 may accordingly hold (delay) the display data having the input tone Din within the addition circuit 42.

Figure 4:
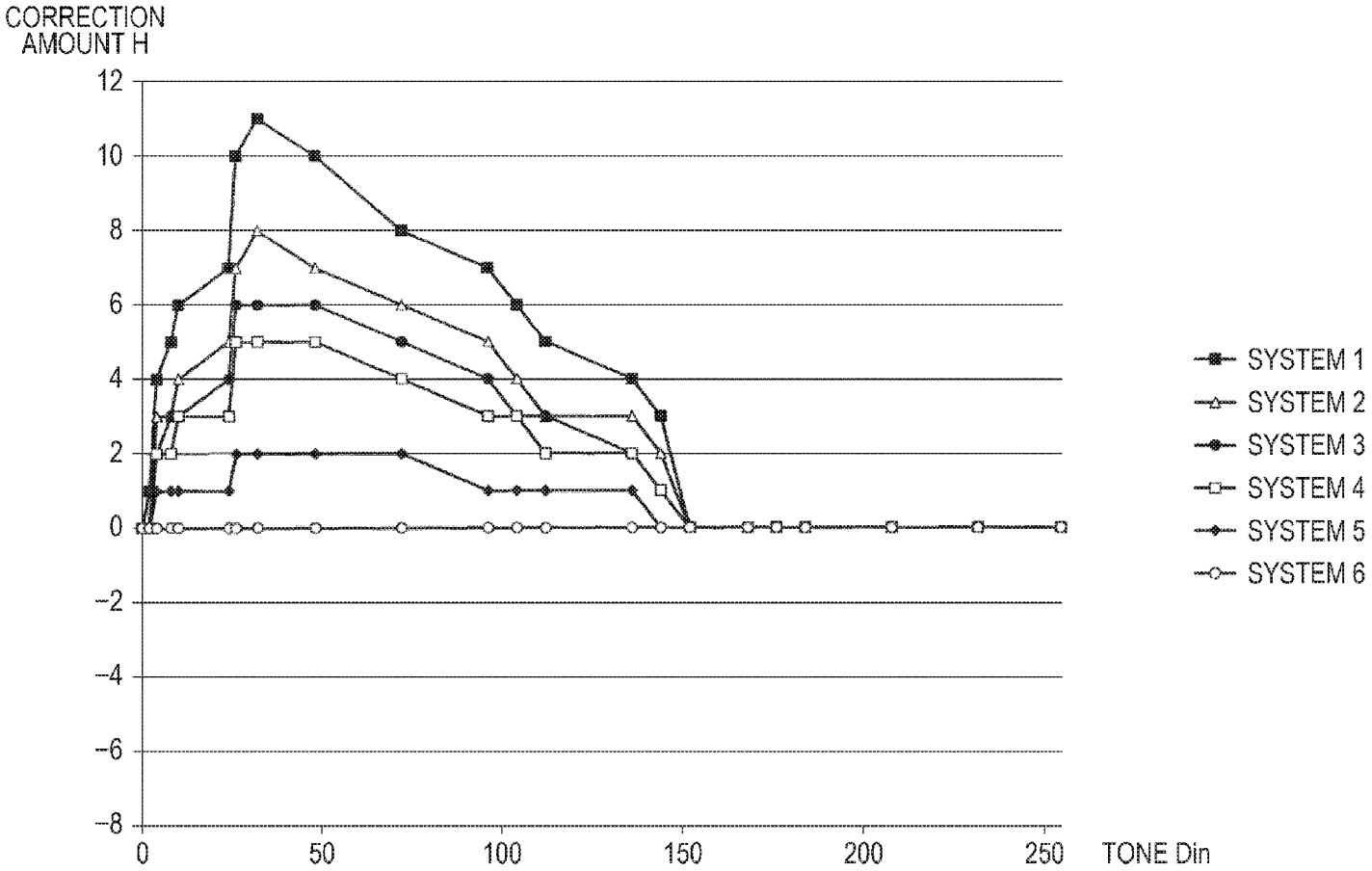
FIG. 4 is a graph illustrating examples of correction amounts according to the embodiment.

FIG. 4 is a graph illustrating examples of the correction amounts H. In the graph, the horizontal axis represents the input tone Din, and the vertical axis represents the correction amount H. For example, if the tone Din of uncorrected display data is 32 and the correction amount H thereof is 11, the tone Dout of the corrected display data is 43. In these examples, display data with a relatively low tone (Din<152) is corrected (H≠0), and display data with a relatively high tone (152≤Din) is not corrected (H=0). It is needless to say that the display data with any tone may be corrected. Depending on the input tone Din of the display data, the correction amount H is varied. In addition, depending on the column x and the row y of a pixel P (picture element (PE)) to which display data is to be written, the correction amount H is varied.

The correction amounts H of systems 1 to 6 illustrated in FIG. 4 are each a correction amount for display data to be written to pixels (y=2160 or 2161) adjacent to the boundary. It is assumed that the x-coordinate at the center of the screen in the row direction is x0. Here, |x−x0| represents the distance from the center of the screen in the row direction to a pixel. If display data has the same tone Din, the correction amount determination circuit 41 increases the correction amount H as the distance from the center of the screen in the row direction to the pixel decreases. For example, a correction amount H of the system 1 is applied to display data that is to be written to pixels for which |x−x0| is less than a first predetermined value among pixels adjacent to the boundary. A correction amount H of the system 2 is applied to display data that is to be written to pixels for which |x−x0| is greater than or equal to the first predetermined value and less than a second predetermined value among pixels adjacent to the boundary. The second predetermined value is greater than the first predetermined value. With the same tone, the correction amount H of the system 1 is greater than or equal to the correction amount H of the system 2. Similarly, the correction amounts H of the systems 3 to 6 become gradually smaller. As |x−x0| increases, the correction amount determination circuit 41 uses a correction amount H of a system having a greater number. For example, it is possible to use a correction amount H of the system 6 (H=0) as the correction amount H for display data to be written to pixels at or near an end of a display region in the row direction.

Unless otherwise indicated, the degrees of the correction amounts H in accordance with the coordinates of the pixels will be described for a case where the uncorrected display data corresponding to all the pixels has the same tone Din (for example, the entire screen will be displayed in one color (e.g., gray)). In addition, when the entire screen is displayed in one color over a certain period (plurality of frame periods), if the display data corresponding to two pixels has the same corrected tone Dout, two data signal lines corresponding to the two pixels output the same voltage. Note that the corresponding two pixels have the same polarity. On the other hand, if the display data corresponding to the two pixels has different corrected tones Dout, even if the two pixels have the same polarity, two data signal lines corresponding to two pixels output different voltages. To drive each pixel, a voltage in accordance with the tone Dout of corrected display data is output to a data signal line corresponding to the pixel.

In the case of one-color display on the entire screen, the correction amount H for display data to be written to a pixel that is the most distant from the gate drivers 6A to 6D (at the center of the screen in the row direction) among the pixels adjacent to the boundary is greater than the correction amount H for display data to be written to a pixel that is the closest to the gate drivers 6A to 6D (at the ends in the row direction).

The correction amount H for display data to be written to a second-row pixel (y=2159 or 2162) from the boundary may be the same as or smaller than the correction amount H for display data to be written to a first-row pixel from the boundary (pixel adjacent to the boundary). For example, a correction amount of any one of the system 1, the system 3, and the system 6 (H=0) may be used as the correction amount H for display data to be written to the second-row pixel from the boundary. Note that a correction amount of another system may be set in the correction amount table 43 as the correction amount H for display data to be written to the second-row pixel from the boundary. If display data with the same tone Din is to be written to pixels on the same column, the correction amount determination circuit 41 reduces the correction amount H to be smaller for a pixel having a greater distance from the boundary in the column direction (or having a greater row number from the boundary) among pixels having the same color component. For example, in FIG. 2, the correction amount H for the display data to be written to a pixel P1 (first pixel) adjacent to the boundary is greater than the correction amount H for the display data to be written to a pixel P2 (second pixel) not adjacent to the boundary. Note that the correction amount H for the display data to be written to a pixel adjacent to the boundary is the maximum value.

In this manner, by varying the correction amount H depending on the distance from the boundary to a pixel, it becomes possible to suppress a dark line or a bright line that occurs at the boundary (or near the boundary) if tone correction is not performed. In particular, by varying the correction amount H depending on whether or not a pixel is adjacent to the boundary (whether a pixel is on the first row or on the second or subsequent row from the boundary), it becomes possible to appropriately correct the display at a row adjacent to the boundary where driving is discontinuous. Here, the boundary correction circuits 4A and 4B correct the tone of the display data to be higher as the correction amount H is greater. Accordingly, the display in pixels at and near the boundary can be corrected to be bright, thereby suppressing a dark line.

For example, in FIG. 2, the correction amount H for the display data to be written to the pixel P1 (first pixel) adjacent to the boundary in the display region 8B may be the same as or different from the correction amount H for the display data to be written to a pixel P3 (third pixel) adjacent to the boundary in the display region 8A. If the top-row pixel in the display region 8B is more influenced by, for example, a rounded waveform, appropriate tone correction can be performed by increasing the correction amount H for the display data to be written to the pixel P1 to be greater than the correction amount H for the display data to be written to the pixel P3. In this manner, correction amounts H may be changed between the upper region and the lower region of the boundary. For example, tone correction may be performed only on the display data for either one (e.g., the display region 8B) of the display regions. In such a case, the boundary correction circuit 4A for the display region 8A can be omitted.

Figure 5:
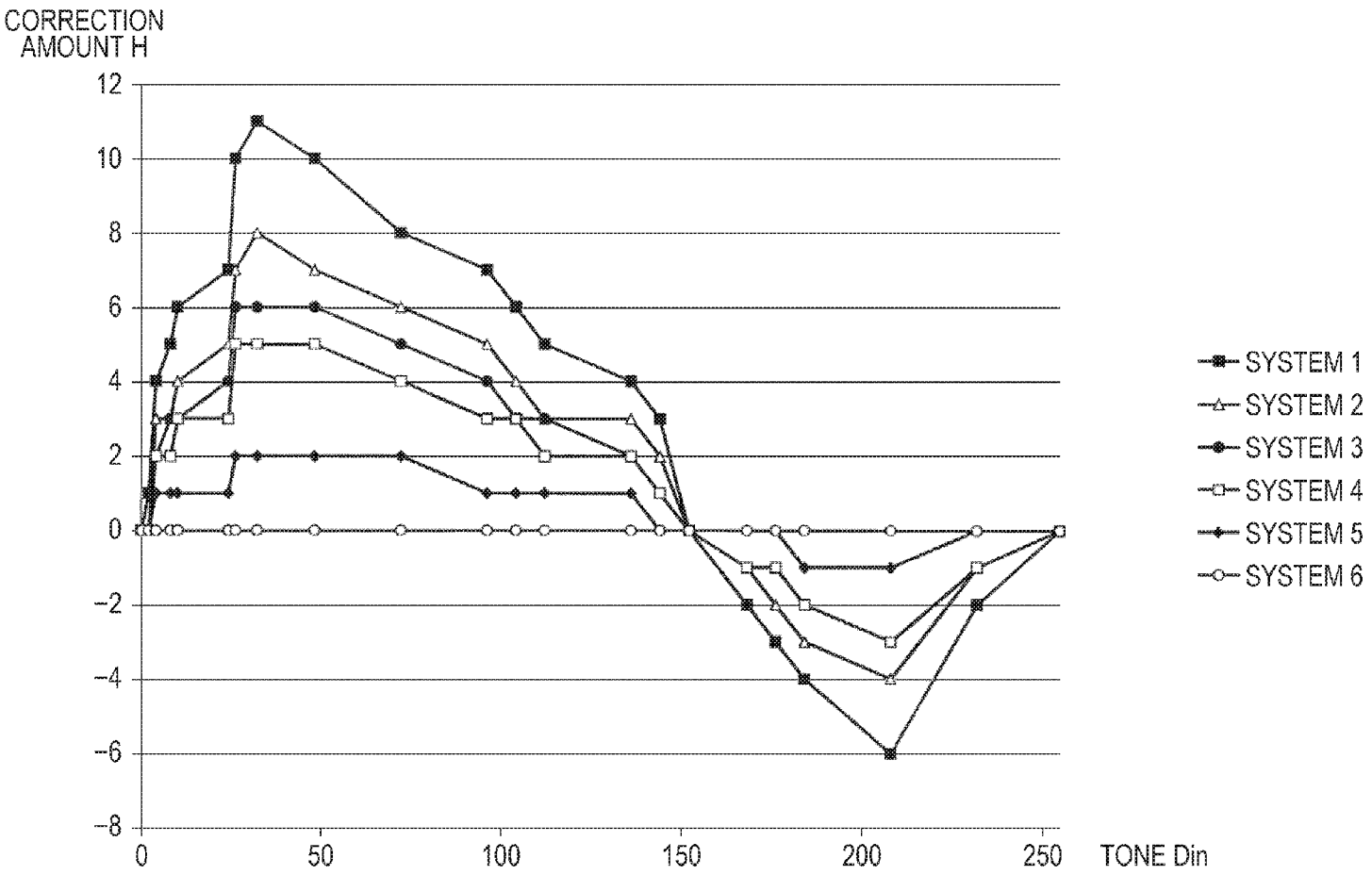
FIG. 5 is a graph illustrating other examples of correction amounts according to the embodiment.

FIG. 5 is a graph illustrating other examples of correction amounts H. In the graph, the horizontal axis represents the input tone Din, and the vertical axis represents the correction amount H. In this example, the display data with a high tone ($152 \leq Din$) is corrected in such a manner that the tone is decreased ($H<0$). In this manner, depending on the property of the display panel 7, some tones may be corrected to be higher, and the other tones may be corrected to be lower. Also in such a case, the correction amount (absolute value) becomes greater as the distance of a pixel to the boundary increases or as the distance of a pixel from the gate drivers 6A to 6D increases. In each column, the correction amount for display data corresponding to a pixel is decreased as the distance of the pixel from the boundary increases.

In a manufacturing process, while checking actual display states of the display device, values in the correction amount table as illustrated in FIG. 4 are set or changed in such a manner that a dark line or a bright line becomes invisible. A plurality of identical display devices may be subjected to tone correction based on the same correction amount table. If the plurality of display devices have the same configuration, tendencies including the rounded waveform are assumed to be similar. On the other hand, if the display devices have markedly different properties, for example, on the basis of a default correction amount table, the correction amount may be adjusted (changed) for each display device in accordance with the display state thereof.

Note that the same correction amount H may be applied for the R, G, and B pixels in a single picture element, or the correction amount H may be varied for each color component.

Second Embodiment

A second embodiment of the present disclosure is now described. For convenience of description, members having the same functions as those described in the above embodiment are denoted by the same reference numerals, and description thereof is omitted. This embodiment differs from the above embodiment in that the correction amount table 43 stores a less number of values.

It is assumed that the number of tones is 256 and the number of picture elements corresponds to 8K4K (7680 picture elements in width and 4320 picture elements in length). If individual correction amounts H are to be set for all of the tones and all of the x-coordinates, the correction amount table 43 is to store 256×7680 values (about 2 MB) for each row.

In this embodiment, the correction amount table 43 stores some correction amounts H that are obtained from some tones Din and rows y from among a plurality of rows in which correction is to be performed. For example, the correction amount table 43 stores the correction amounts H of the system 1 illustrated in FIG. 4 corresponding to discontinuous tones Din (marked points) as the correction amounts for pixels on a row adjacent to the boundary. The correction amount table 43 separately stores the correction amounts for pixels in another row (e.g., the third row). The correction amount table 43 may further store the correction amounts H of the systems 2 to 6 and the like corresponding to discontinuous columns x; however, the correction amount determination circuit 41 here calculates a correction amount for a pixel on a given column x on the basis of a correction amount H of the system 1.

The correction amount determination circuit 41 obtains, by interpolation (e.g., linear interpolation) using the known plurality of correction amounts set in the correction amount table 43, the input tone Din of the display data and the correction amount in accordance with coordinates (x, y) of a pixel to which the display data is to be written. Note that the correction amount H of system 1 is used as the correction amount in accordance with the x-coordinate of a pixel at the center in the row direction, the correction amount corresponding to a pixel at each end in the row direction is assumed to be 0, and interpolation is performed between these two values. For example, the correction amount H for the display data having a tone Din of 48 corresponding to a pixel at the center of the row adjacent to the boundary is 10 (see FIG. 4). If the tone Din of display data is 48, the correction amount corresponding to a pixel on a given column x and on the row adjacent to the boundary is obtained by multiplying 10 by $(1-|(x/x0)-1|)$. In the case where none of Din, x, and y are set in the correction amount table 43, since there are three variables, the correction amount determination circuit 41 obtains eight peripheral known correction amounts H from the correction amount table 43 and performs interpolation using the eight correction amounts H, thereby obtaining the correction amount in accordance with the above Din, x, and y.

In this manner, the correction amount determination circuit 41 may determine the correction amount in accordance with the tone and coordinates between discontinuous tones and coordinates by performing interpolation on the basis of the correction amounts H set for the discontinuous tones and coordinates. Accordingly, the data amounts of the correction amounts stored in the correction amount table 43 can be reduced.

Note that the correction amount table 43 may store the correction amount for each position y in the column direction. Alternatively, the correction amount determination circuit 41 may determine the correction amount corresponding to a pixel distant from the boundary by, for example, multiplying another correction amount (for example, a correction amount for a pixel adjacent to the boundary (e.g., a correction amount of the system 1 illustrated in FIGS. 4 and 5)) by a coefficient that decreases as the distance from the boundary increases.

Third Embodiment

A third embodiment of the present disclosure is now described. For convenience of description, members having the same functions as those described in the above embodiments are denoted by the same reference numerals, and description thereof is omitted. In this embodiment, tone correction that is more appropriate for multi-picture-element driving is performed.

Figure 6:
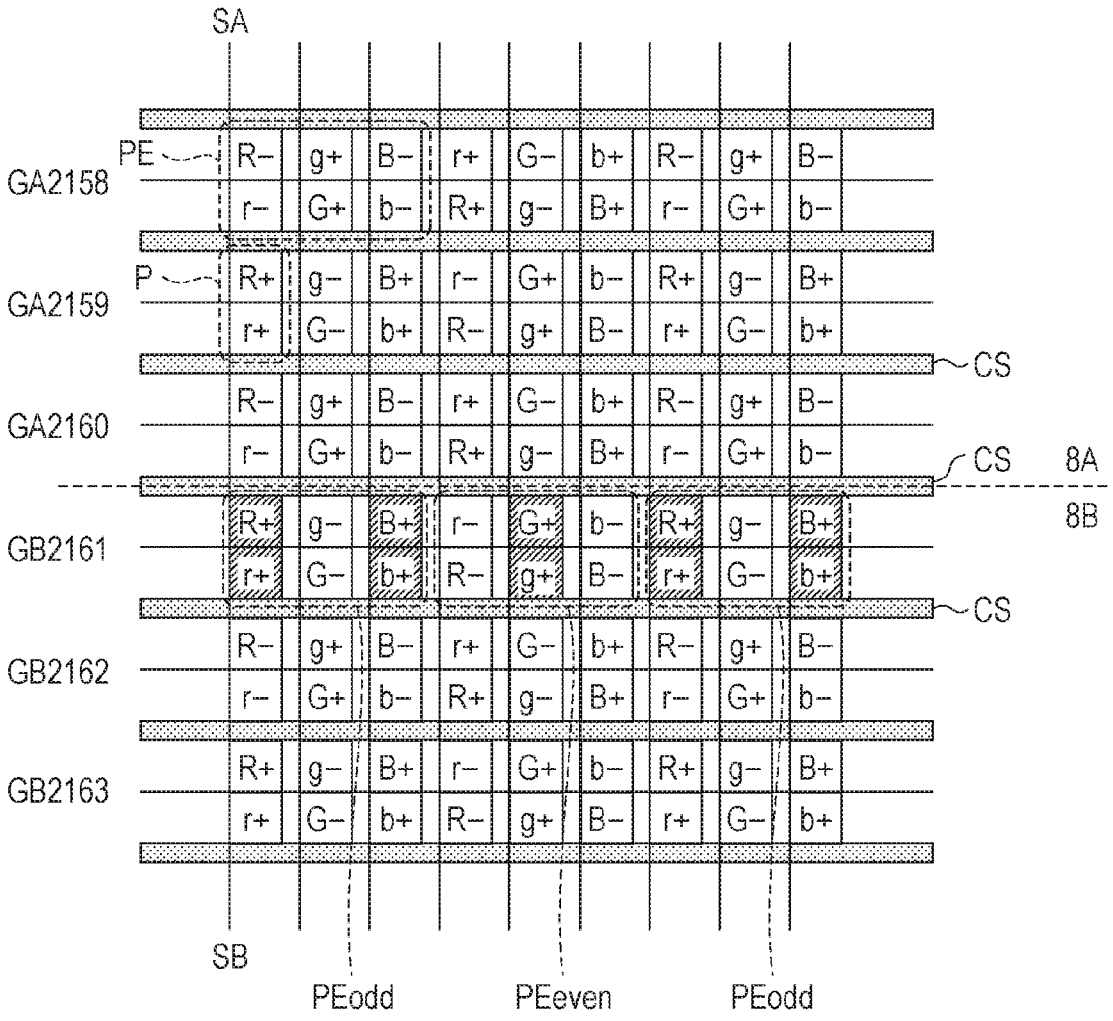
FIG. 6 is an enlarged view of a schematic configuration of the display panel of the display device at and near the boundary between divided display regions.

FIG. 6 is an enlarged view of a schematic configuration of the display panel 7 at and near the boundary between divided display regions. Letters such as R, G, and B have the same meaning as those in FIG. 2. A bright sub-pixel and a dark sub-pixel in each pixel P are arrayed in a direction in which the data signal lines SA extend. In the top-row picture elements in the display region 8B, picture elements PEodd in odd-number columns (x=1, 3, 5 . . . ) include bright red, dark green, and bright blue sub-pixels adjacent to the boundary. On the other hand, picture elements PEeven in even-number columns (x=2, 4, 6 . . . ) include dark red, bright green, and dark blue sub-pixels adjacent to the boundary.

The boundary correction circuit 4B corrects display data to be written to red pixels and blue pixels and does not correct display data to be written to green pixels in the odd-number picture elements PEodd among the picture elements adjacent to the boundary in the display region 8B. The boundary correction circuit 4B also corrects display data to be written to green pixels and does not correct display data to be written to red pixels or blue pixels in the even-number picture elements PEeven among the picture elements adjacent to the boundary in the display region 8B. As a correction amount, for example, a correction amount of the system 1 illustrated in FIGS. 4 and 5 may be used. Accordingly, correction is performed on display data to be written to the shaded pixels illustrated in FIG. 6. The shaded pixels include bright sub-pixels adjacent to the boundary between the display regions 8A and 8B. In particular, with low tones where tone correction is to be preformed, dark sub-pixels have less influence on display, and bright sub-pixels have more influence on display. Accordingly, the boundary correction circuit 4B corrects only display data corresponding to the pixels including bright sub-pixels adjacent to the boundary among the pixels P adjacent to the boundary. This produces substantially the same effects as in the case where only the display data corresponding to bright sub-pixels adjacent to the boundary is corrected in a unit corresponding to half of the picture element row. Therefore, it is possible to perform more appropriate tone correction in accordance with the distance from the boundary. Accordingly, compared with the case in which tone correction is performed without taking the above distance into account, it is possible to improve the effects of increasing the viewing angle by using the difference between liquid crystal orientations in bright sub-pixels and dark sub-pixels, thereby increasing the display quality of the display device 1.

Note that the bottom-row picture elements in the display region 8A may not be corrected or may be corrected in the same manner as in the display region 8B. In the case where correction is performed, display data corresponding to pixels including bright sub-pixels adjacent to the boundary is corrected. The correction amount for the bottom-row pixels in the display region 8A and the top-row pixels in the display region 8B may be the same or different.

Fourth Embodiment

A fourth embodiment of the present disclosure is now described. For convenience of description, members having the same functions as those described in the above embodiments are denoted by the same reference numerals, and description thereof is omitted. This embodiment differs from the third embodiment in that correction is also performed for pixels including dark sub-pixels adjacent to the boundary.

In the odd-number picture elements PEodd among the picture elements adjacent to the boundary in the display region 8B, the boundary correction circuit 4B corrects display data to be written to red and blue pixels by using a correction amount H1 and corrects display data to be written to green pixels by using a correction amount H2. Note that the correction amount H1 is greater than the correction amount H2. In addition, in the even-number picture elements PEeven among the picture elements adjacent to the boundary in the display region 8B, the boundary correction circuit 4B corrects display data to be written to green pixels by using a correction amount H3 and corrects display data to be written to red and blue pixels by using a correction amount H4. Note that the correction amount H3 is greater than the correction amount H4 and the correction amount H2. It is needless to say that the correction amounts H1 to H4 change depending on the tone Din and the column x and are determined on the basis of the correction amount table 43. That is, the correction amount H for display data to be written to a pixel is changeable depending on the tone Din, the column x of the pixel (picture element), and the distance y' from the boundary to a bright sub-pixel. Accordingly, it is possible to correct display data corresponding to each pixel in a unit corresponding to half of the picture element row.

In the same manner as in the first-row picture elements, it is also possible to correct display data corresponding to picture elements on the second and subsequent rows from the boundary by using correction amounts that monotonically decrease depending on the distance y' from the boundary to a bright sub-pixel separately for the odd-number picture elements and the even-number picture elements.

In the same manner, also in the display region 8A, the boundary correction circuit 4A may correct display data by using correction amounts that monotonically decrease depending on the distance y' from the boundary to a bright sub-pixel separately for the odd-number picture elements and the even-number picture elements.

Note that the correction amount table 43 may store the correction amount for each position y' in the column direction. Alternatively, the correction amount determination circuit 41 may determine the correction amount corresponding to a pixel distant from the boundary by, for example, multiplying another correction amount (for example, a correction amount for a pixel adjacent to the boundary (e.g., a correction amount of the system 1 illustrated in FIGS. 4 and 5)) by a coefficient that decreases as the distance from the boundary increases.

Modifications

Examples in which the display region of the display panel 7 is horizontally divided into two display regions have been described above. An embodiment of the present disclosure can also be applied to the case where the display region of the display panel 7 is vertically divided into two display regions. Also in this case, the scan signal lines are separated at the boundary between the left and right display regions. Furthermore, an embodiment of the present disclosure can also be applied to the case where the display region is vertically and horizontally divided. In such cases, the display device corrects display data by using different correction amounts depending on distances from the boundary to pixels (or picture elements).

Conclusion

A display device (1) according to a first aspect of the present disclosure includes a display panel (7) including a first display region (8A) and a second display region (8B) that are adjacent to each other and configured to be driven by using mutually different scan signal line groups and mutually different data signal line groups, and a tone correction unit (boundary correction circuits 4A and 4B) configured to perform tone correction on display data having a certain tone in such a manner that a correction amount for the display data to be written to a first pixel (P1) adjacent to a boundary between the first display region and the second display region and a correction amount for the display data to be written to a second pixel (P2) not adjacent to the boundary are different from each other.

The above configuration enables correction by using different correction amounts for the display data to be written to the first pixel adjacent to the boundary and the display data to be written to the second pixel not adjacent to the boundary. Accordingly, it becomes possible to suppress a dark line or bright line that occurs at or near the boundary, resulting in increased display quality at the boundary portion between the divided display regions. Note that the correction amount for the display data to be written to the second pixel may be greater than 0 or may be 0.

A display device according to a second aspect of the present disclosure may be the display device according to the first aspect in which the tone correction unit varies the correction amount for the display data depending on whether or not a pixel to which the display data is to be written is adjacent to the boundary.

In the above configuration, the correction amount for the display data is varied depending on whether or not a pixel is adjacent to the boundary. For example, the correction amount is varied between the display data to be written to a first-row pixel from the boundary and the display data to be written to a second-row pixel from the boundary. Accordingly, it becomes possible to appropriately suppress a dark line or bright line that occurs at the boundary portion.

A display device according to a third aspect of the present disclosure may be the display device according to the first or second aspect in which the correction amount for the display data to be written to the first pixel is greater than the correction amount for the display data to be written to the second pixel.

In the above configuration, the degree of correction can be greater for the pixel adjacent to the boundary. Accordingly, it becomes possible to suppress a dark line or bright line that occurs at the boundary portion.

A display device according to a fourth aspect of the present disclosure may be the display device according to any one of the first to third aspects in which the first display region and the second display region are arranged in a direction in which data signal lines extend, and in which, the correction amount for the display data to be written to the first pixel is greater in a case where the first pixel is most distant from a scan signal line driver than in a case where the first pixel is closest to the scan signal line driver.

In the above configuration, it is possible to compensate for the influence of a rounded waveform of a scan signal. Accordingly, it becomes possible to suppress a dark line or bright line that easily occurs particularly at the center portion of the boundary.

A display device according to a fifth aspect of the present disclosure may be the display device according to any one of the first to fourth aspects in which the correction amount for the display data corresponding to the first pixel adjacent to the boundary is a maximum value.

In the above configuration, it is possible to set, to the maximum value, the correction amount for the display data corresponding to the pixel at or near the boundary at which the signal waveform is most rounded. Accordingly, it becomes possible to appropriately compensate for the influence of the rounded signal waveform.

A display device according to a sixth aspect of the present disclosure may be the display device according to any one of the first to fifth aspects in which, if the first pixel adjacent to the boundary in the second display region is scanned initially in a frame period and a third pixel adjacent to the boundary in the first display region is scanned eventually in a frame period, the correction amount for the display data to be written to the first pixel is greater than a correction amount for display data to be written to the third pixel.

In the first display region and the second display region, the rounded signal waveform differently influences the pixels adjacent to the boundary. In the above configuration, it is possible to appropriately perform correction based on whether the pixels are in the first display region or the second display region.

A display device according to a seventh aspect of the present disclosure may be the display device according to any one of the three to sixth aspects in which the tone correction unit corrects the tone of the display data to be higher as the correction amount is greater.

Owing to the influence of the rounded signal waveform, a dark line easily occurs at the boundary portion. In the above configuration, it is possible to suppress a dark line that occurs at the boundary portion.

A display device according to an eighth aspect of the present disclosure may be the display device according to any one of the first to seventh aspects in which the tone correction unit refers to a correction amount table in which a plurality of correction amounts are set for some pixels having coordinates and for some tones and determines a correction amount for display data having a tone, other than the some tones, to be written to a pixel having coordinates other than the coordinates by performing interpolation using the plurality of correction amounts in the correction amount table.

In the above configuration, it is possible to reduce the number of data items set in the correction amount table.

A display device according to a ninth aspect of the present disclosure may be the display device according to any one of the first to eighth aspects in which, by performing the tone correction, the tone correction unit suppresses a dark line that occurs at the boundary if the tone correction is not performed.

A display device according to a tenth aspect of the present disclosure may be the display device according to any one of the first to ninth aspects in which each pixel includes a bright sub-pixel and a dark sub-pixel, and in which a correction amount for display data to be written to the bright sub-pixel is varied depending on a distance from the boundary to the bright sub-pixel.

In the above configuration, it is possible to perform correction by using an appropriate correction amount for each pixel depending on the position of the bright sub-pixel having a strong influence even if the positions of the bright sub-pixel and the dark sub-pixel vary for different pixels.

A display device according to an eleventh aspect of the present disclosure may be the display device according to the tenth aspect in which the correction amount for the display data to be written to the first pixel including a bright sub-pixel adjacent to the boundary is greater than a correction amount for display data to be written to a fourth pixel including a dark sub-pixel adjacent to the boundary.

In the above configuration, it is possible to vary the correction amount between the case where the bright sub-pixel is adjacent to the boundary and the case where the dark sub-pixel is adjacent to the boundary among the plurality of pixels adjacent to the boundary. Accordingly, it becomes possible to increase the degree of correction for a pixel including the bright sub-pixel adjacent to the boundary, which has more influence.

A display device according to a twelfth aspect of the present disclosure includes a display panel including a first display region and a second display region that are adjacent to each other and configured to be driven by using mutually different scan signal line groups and mutually different data signal line groups in which an output voltage of a data signal line corresponding to a first pixel that is adjacent to a boundary between the first display region and the second display region and that displays display data having a certain tone with a polarity is different from an output voltage of a data signal line corresponding to a second pixel that is not adjacent to the boundary and that displays display data having the same tone with the same polarity.

A method for controlling a display device according to a thirteenth aspect of the present disclosure, the display device including a display panel including a first display region and a second display region that are adjacent to each other and configured to be driven by using mutually different scan signal line groups and mutually different data signal line groups, includes performing tone correction on display data having a certain tone in such a manner that a correction amount for the display data to be written to a first pixel adjacent to a boundary between the first display region and the second display region and a correction amount for the display data to be written to a second pixel not adjacent to the boundary are different from each other.

A method for driving a display device according to a fourteenth aspect of the present disclosure, the display device including a display panel including a first display region and a second display region that are adjacent to each other and configured to be driven by using mutually different scan signal line groups and mutually different data signal line groups, the method includes causing an output voltage of a data signal line corresponding to a first pixel to differ from an output voltage of a data signal line corresponding to a second pixel, the first pixel being adjacent to a boundary between the first display region and the second display region and displaying display data having a certain tone with a polarity, the second pixel being not adjacent to the boundary and displaying display data having the same tone with the same polarity.

The present disclosure is not limited to the above-described embodiments and can be modified in various manners without departing from the scope indicated by the claims. An embodiment obtained by an appropriate combination of technical items disclosed in different embodiments is also included in the technical scope of the present disclosure. Furthermore, by a combination of technical items disclosed in the embodiments, a novel special technical feature can be obtained.

An embodiment of the present disclosure can be used for a display device.

The present disclosure contains subject matter related to that disclosed in Japanese Priority Patent Application JP 2015-116108 filed in the Japan Patent Office on Jun. 8, 2015, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising:

a display panel including a first display region and a second display region that are adjacent to each other and configured to be driven by using mutually different scan signal line groups and mutually different data signal line groups; and a tone correction unit configured to perform tone correction on display data having a certain tone in such a manner that a correction amount for the display data to be written to a first pixel adjacent to a boundary between the first display region and the second display region and a correction amount for the display data to be written to a second pixel not adjacent to the boundary are different from each other;

wherein, the first pixel is located in the second region adjacent to the boundary between the first display region and the second display region, a third pixel is located in the first region adjacent to the boundary between the first display region and the second display region, the first pixel is scanned initially in a frame period and a third pixel is scanned eventually in the same frame period, the correction amount for the display data having the certain tone to be written to the first pixel is greater than a correction amount for the display data having the certain tone to be written to the third pixel.

2. The display device according to claim 1, wherein the tone correction unit varies the correction amount for the display data depending on whether or not a pixel to which the display data is to be written is adjacent to the boundary.

3. The display device according to claim 1, wherein the correction amount for the display data to be written to the first pixel is greater than the correction amount for the display data to be written to the second pixel.

4. The display device according to claim 3, wherein the tone correction unit corrects the tone of the display data to be higher as the correction amount is greater.

5. The display device according to claim 1, wherein the first display region and the second display region are arranged in a direction in which data signal lines extend, and wherein the correction amount for the display data to be written to the first pixel is greater in a case where the first pixel is most distant from a scan signal line driver than in a case where the first pixel is closest to the scan signal line driver.

6. The display device according to claim 1, wherein the correction amount for the display data to be written to the first pixel adjacent to the boundary is a maximum value.

7. The display device according to claim 1, wherein the tone correction unit refers to a correction amount table in which a plurality of correction amounts are set for some pixels having coordinates and for some tones and determines a correction amount for display data having a tone, other than the some tones, to be written to a pixel having coordinates other than the coordinates by performing interpolation using the plurality of correction amounts in the correction amount table.

8. The display device according to claim 1, wherein, by performing the tone correction, the tone correction unit suppresses a dark line that occurs at the boundary if the tone correction is not performed.

9. The display device according to claim 1, wherein each pixel includes a bright sub-pixel and a dark sub-pixel, and wherein a correction amount for display data to be written to the bright sub-pixel is varied depending on a distance from the boundary to the bright sub-pixel.

10. A display device, comprising:

a display panel including a first display region and a second display region that are adjacent to each other and configured to be driven by using mutually different scan signal line groups and mutually different data signal line groups; and a tone correction unit configured to perform tone correction on display data having a certain tone in such a manner that a correction amount for the display data to be written to a first pixel adjacent to a boundary between the first display region and the second display region and a correction amount for the display data to be written to a second pixel not adjacent to the boundary are different from each other;

wherein each pixel includes a bright sub-pixel and a dark sub-pixel, same display data being written to the bright sub-pixel and the dark sub-pixel, wherein the first pixel is in the second display region adjacent to the boundary between the first display region and the second display region, the first pixel includes a bright sub-pixel, the bright sub-pixel is adjacent to the boundary, a fourth pixel is in the second display region adjacent to the boundary between the first display region and the second display region, and the fourth pixel includes a dark sub-pixel, the dark sub-pixel is adjacent to the boundary and wherein the correction amount for the display data having the certain tone to be written to the first pixel is greater than a correction amount for display data having the certain tone to be written to a fourth pixel.

11. A display device comprising:

a display panel including a first display region and a second display region that are adjacent to each other and configured to be driven by using mutually different scan signal line groups and mutually different data signal line groups, wherein an output voltage of a data signal line corresponding to a first pixel that is adjacent to a boundary between the first display region and the second display region and that displays display data having a certain tone with a polarity is different from an output voltage of a data signal line corresponding to a second pixel that is not adjacent to the boundary and that displays display data having the same tone with the same polarity, wherein the first pixel is in the second display region adjacent to the boundary between the first display region and the second display region, the third pixel is in the first display region adjacent to the boundary between the first display region and the second display region, the first pixel is scanned initially in a frame period, and a third pixel adjacent to the boundary in the first display region is scanned eventually in the same frame period; and wherein the output voltage of the data signal line corresponding to the first pixel that displays the display data having the certain tone with a positive polarity is greater than an output voltage of a data signal line corresponding to the third pixel that displays the display data having the certain tone with the positive polarity.

12. A display device comprising:

a display panel including a first display region and a second display region that are adjacent to each other and configured to be driven by using mutually different scan signal line groups and mutually different data signal line groups, wherein an output voltage of a data signal line corresponding to a first pixel that is adjacent to a boundary between the first display region and the second display region and that displays display data having a certain tone with a polarity is different from an output voltage of a data signal line corresponding to a second pixel that is not adjacent to the boundary and that displays display data having the same tone with the same polarity, wherein each pixel includes a bright sub-pixel and a dark sub-pixel, same display data being written to the bright sub-pixel and the dark sub-pixel, wherein the first pixel is in the second display region adjacent to the boundary between the first display region and the second display region, the first pixel includes a bright sub-pixel, the bright sub-pixel is adjacent to the boundary, a fourth pixel is in the second display region adjacent to the boundary between the first display region and the second display region, and the fourth pixel includes a dark sub-pixel, the dark sub-pixel is adjacent to the boundary; and wherein the output voltage of the data signal line corresponding to the first pixel that displays the display data having the certain tone with a positive polarity is greater than an output voltage of a data signal line corresponding to the fourth pixel that displays the display data having the certain tone with the positive polarity.

* * * * *